United States Patent [19]

Schuster et al.

[11] 3,998,441

[45] Dec. 21, 1976

[54] FURNACE FOR TEMPERING AND HARDENING WORKPIECES

[75] Inventors: Rolf Schuster, Hanau; Erwin Schumann, Bruchkobel, both of Germany

[73] Assignee: Deutsche Gold- und Silber-Scheideanstalt Vormals Roessler, Frankfurt, Germany

[22] Filed: May 24, 1976

[21] Appl. No.: 689,516

[30] Foreign Application Priority Data

May 30, 1975 Germany ..... 2523952

[52] U.S. Cl. ..... 266/250; 266/252

[51] Int. Cl.[2] ..... C21D 1/00

[58] Field of Search ..... 432/15, 58; 266/249–254, 257, 259

[56] References Cited

UNITED STATES PATENTS 3,197,328 7/1965 Jung et al. ..... 266/250

*Primary Examiner*—Gerald A. Dost

*Attorney, Agent, or Firm*—Cushman, Darby & Cushman

[57] ABSTRACT

There is provided a furnace for tempering and hardening workpieces comprising an annealing chamber and a quenching chamber constructed as a fluidized bed, the quenching chamber is arranged below the annealing chamber, the fluidized bed which is stationary during the annealing treatment serves as bottom temperature insulation for the annealing chamber, and the lateral heat insulation of the annealing chamber is extended to below the surface of the stationary fluidized bed.

3 Claims, 3 Drawing Figures

FURNACE FOR TEMPERING AND HARDENING WORKPIECES

The invention concerns a furance consisting of an annealing chamber and a quenching chamber constructed as a fluidized bed for tempering and hardening of workpieces, and to a process of using such a furnace.

A heat treatment plant for tempering and hardening workpieces generally consists of a tempering chamber and a quenching or cooling chamber. In most cases the quenching or cooling chamber is arranged beside the annealing chamber so that to effect the changing of the workpiece or charge from the annealing chamber to the quenching chamber, there is always necessary a generally horizontal or lateral transportation of the workpiece before lowering into the quenching medium. A simpler solution from a construction standpoint is represented by the arrangement of the quenching or cooling chamber directly below the annealing chamber.

However, in practice, this principle of construction has not been able to be carried out since the advantage resulting from the fact that the charge is not to be transported crosswise, also gives rise to certain serious disadvantages. For example, the liquids used as the quenching medium, such as, for example, water, salt melts or oil, at the moment of quenching from vapors which rise into the annealing chamber and damage the internal parts of the annealing chamber and influence the atmosphere of the furnace. This inconvenience is not removed by simple means since, during the quenching process, necessarily, the vertical passage between the furnace and the quenching chamber must be open for passing the charge.

Besides, in the past, for the purpose of thermal insulation between the annealing chamber and the quench container, there must be provided a movable heat protector slide or damper member. Of course, it is possible to lower the bottom heat protector together with the charge into the quenching bath. However, this has the disadvantage that this bottom protector is distorted by the frequent quenching and accordingly has only a short life. In addition, the bottom must be carefully purified from the quenching medium after each treatment.

The occurrence of injurious vapors can be prevented if there is used a fluidized bed as the quenching chamber, see Bennett, Metal Progress Vol. 79 (1961) No. 4 pages 82–87, the entire disclosure of which is hereby incorporated by reference and relied upon. The quenching chamber, however, likewise is disconnected sidewise of the annealing chamber, so that in this apparatus also the heat treated workpieces must travel a relatively long way between the annealing chamber and the quenching chamber.

Therefore, it is an object of the present invention to construct a furnace for tempering and hardening workpieces which comprises an annealing chamber and a quenching chamber in which there is no relatively lengthy path of travel of the annealed workpieces between the annealing chamber and the quenching chamber and in which there is guaranteed a simpler bottom heat protection.

In summary, the present invention involves constructing a fluidized bed quenching chamber below the annealing chamber in such manner that the fluid bed which is stationary during the annealing treatment serves as the bottom heat insulation for the annealing chamber and the lateral heat insulation of the annealing chamber is extended to below the surface of the stationary fluidized bed.

The solid particles of the fluidized material which are held in suspension by a gas stream can be heated and cooled and therefore also make possible the very advantageous treating of workpieces in different temperature ranges. Thus, for example, as shown in Bennett there can be quenching from 1600° to over 2000° F. to a temperature of 600° F. or to 500° F., or to 350° F.

The furnace arrangement of the invention by the constructive fusion of an annealing chamber with the fluidized bed as the quenching chamber attains a special simplification of the heat treatment plant which consists of an annealing chamber and a quenching chamber since the upper part of the fluidized bed at the same time overlaps the bottom insulation of the annealing chamber.

The invention will be understood best in connection with the drawings wherein.

In the drawings like numbers refer to like parts.

Figure 1:
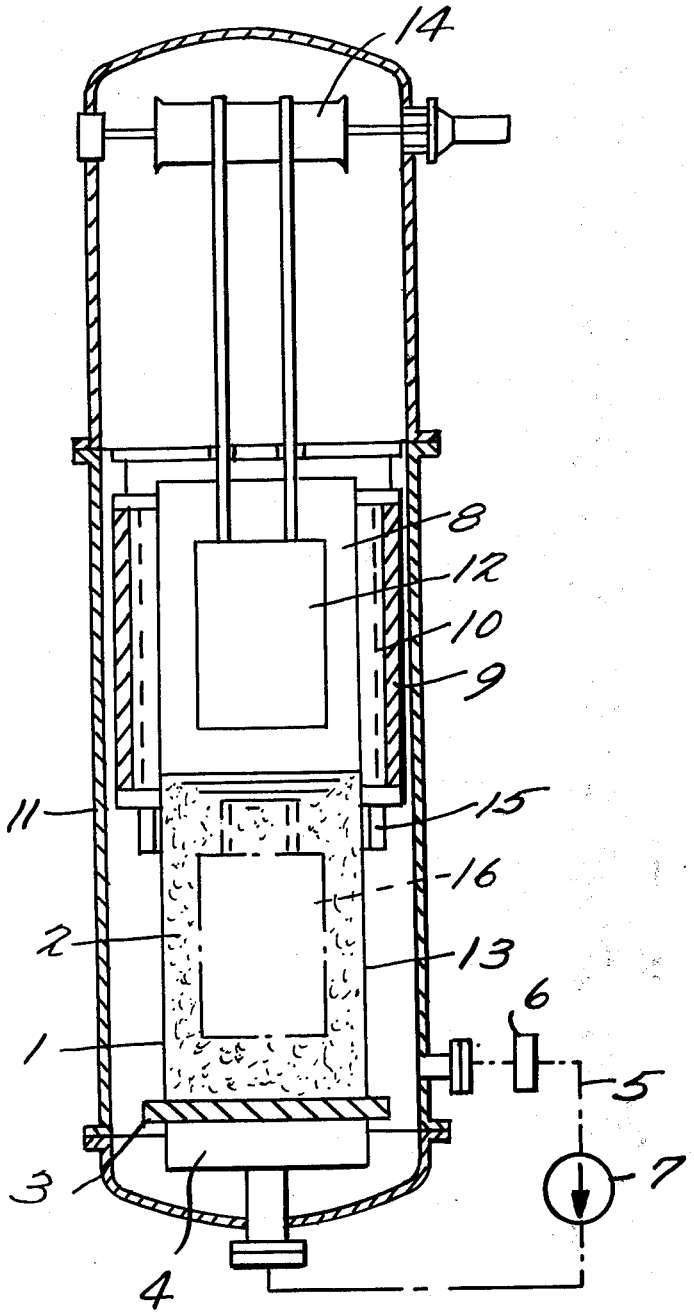
FIG. 1 is a schematic longitudinal sectional illustration of one form of furnace according to the invention.

Referring more specifically to FIG. 1 of the drawings, there is shown a longitudinal section through such a furnace which is designated generically at 20. In this example the furnace is constructed as a vacuum furnace but it is also possible to operate with a protective gas, e.g. argon or helium or other gas inert to the metal of the workpiece. The furnace consists of a quenching chamber 1 with a fluidized bed 2 e.g. made of $Al_2O_3$ powder, (although any other appropriate finely divided solid can be used, e.g. calcined clay sand such as Albany sand or Olivine sand of zirconium dioxide as shown in Bennett), the diffusion plate 3, the gas distribution space 4, the gas recirculation line 5 including the filter 6 and the circulatory blower 7, and the annealing chamber 8 with the heater 10, the lateral heat insulation 9, as well as the housing 11. Within the cylinder 13 which extends through the annealing chamber 8 and the quenching chamber 1 is found the charge 12, e.g. of steel, in the annealing chamber 8, suspended from the lifting jack 14.

The part 15 of the lateral heat insulation 9 is extended down, e.g. to 22, until the fluidized bed in the stationary condition is effective as the bottom insulation.

The medium used as the fluidized bed, in most cases is a metal oxide powder, e.g. alumina, zirconia or sand, is in sufficient amount or density to be a good heat insulator. The insulation part 15 extends sufficiently below the chamber 8 to insure that the heat can only flow in the direction perpendicular thereto. The charge 12 need only be lowered into the fluidized bed for quenching. As a result, there need not be provided any slidable heat damper between chambers 8 and 1 nor a bottom wall which normally would have to be lowered into the quenching bath. If the charge is lowered deep enough (position 16) the influence of the annealing chamber on the quenching agent is avoided. It is particularly advantageous to construct the furnace of the invention as a vacuum furnace. Upon shutting off the circulation of gas the fluid bed becomes at rest and thus acts as the bottom heat insulation on the floor at 3. The gas stream is inserted first just before the quenching commences and a fluidized bed is produced.

Figure 2:
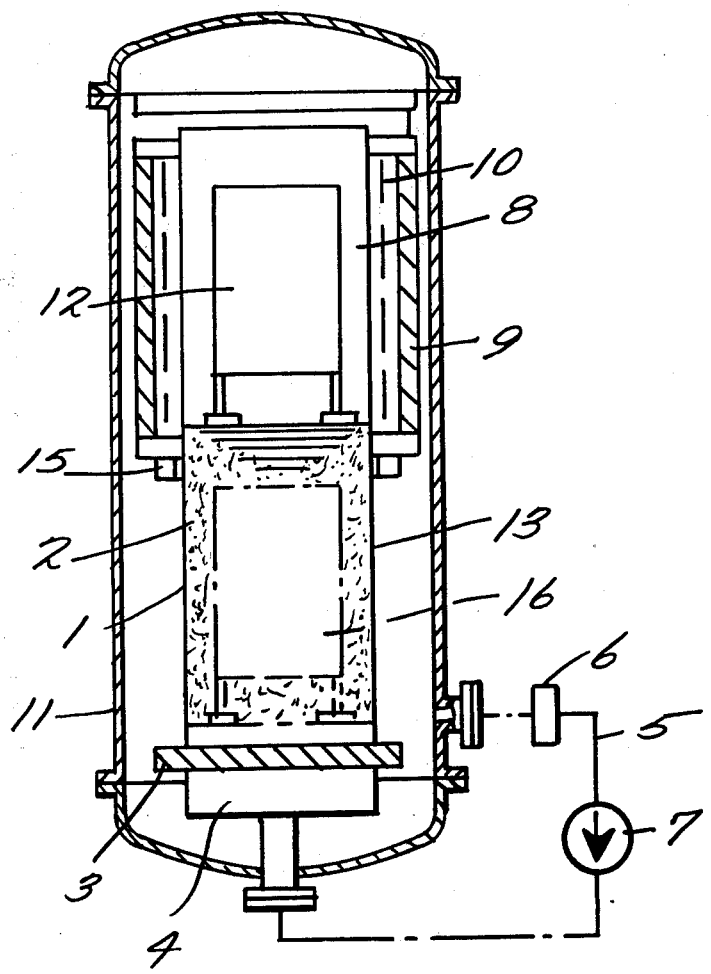
FIG. 2 is a view similar to FIG. 1 but showing the charge on the stationary fluidized bed in annealing.

If the charge or charge suppot in the annealing chamber is placed on the quiescent fluidized bed as shown in FIG. 2 the process of transferring the charge after the annealing is carried out without the help of mechanical assistance. For quenching the fluidized bed is merely activated by introducing the gas stream and the charge 12 automatically changes into the quenching medium.

Figure 3:
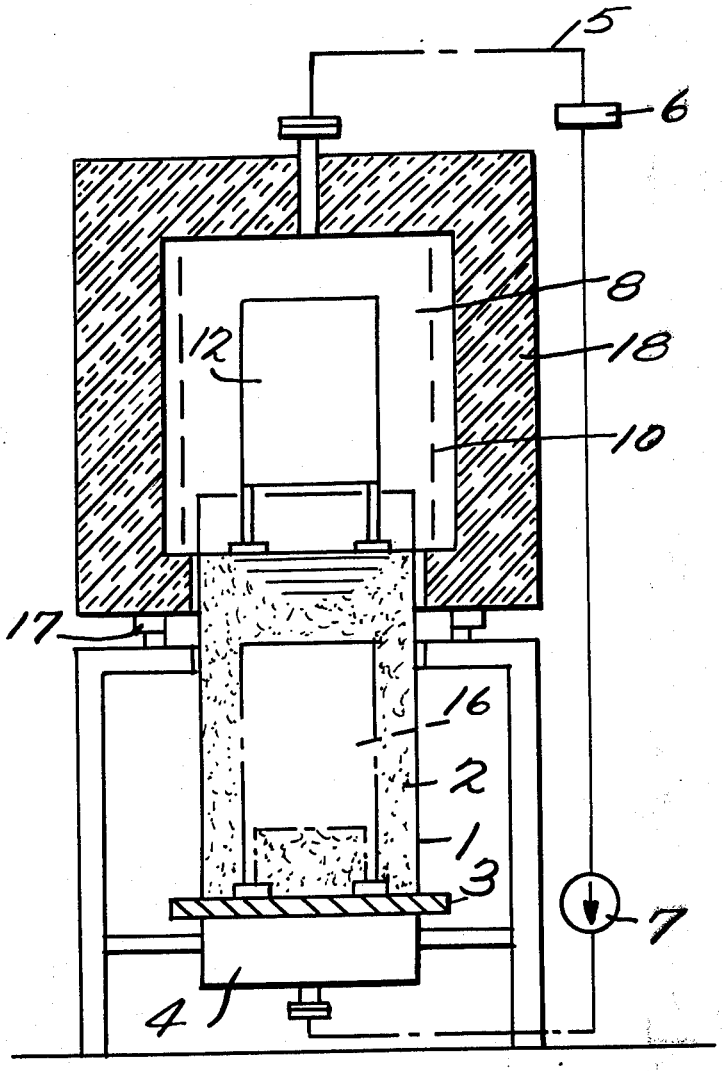
FIG. 3 is a schematic longitudinal section of another form of furnace according to the invention.

A further variant of the furnace of the invention is shown in FIG. 3. This form of the invention with raisable heating dome 18 or lowerable quenching part 1 makes possible the separation of the charge in the fluidized bed after the exchange from the heating dome and to allow the heating dome with a new charge to travel to a second fluidized bed. During the exchange process, the fluidized bed can be flooded with fresh gas to hold the fluidized material in motion and to keep off air from the charge. This separation takes place by loosening the holding apparatus 17.

In all variants of the invention instead of working with recirculating gas thee can also be used a fresh gas stream.

The apparatus can comprise, consist essentially of, or consist of the elements set forth.

EXAMPLE

Steel parts of the type M 2 were annealed in the annealing chamber of the furnace to 1220° C and then lowered into the fluidized bed for quenching. The temperature of the fluidized bed was room temperature and the medium used as the fluidized bed was alumina.

What is claimed is:

1. A furnace suitable for annealing and quenching workpieces comprising an annealing chamber and a quenching chamber disposed vertically below said annealing chamber, said quenching chamber containing a fluidizable bed of solid particles which, when in stationary position, serves as thermal insulation for the bottom of said furnace, means for introducing fluidizing gas into the quenching chamber during the quenching of the workpiece and for preventing the introduction of said gas during annealing of a workpiece and lateral heat insulation on the annealing chamber extending below the upper surface of the fluidized bed when said bed is not in the fluidized condition.

2. A furnace according to claim 1 which is a vacuum furnace.

3. A process for annealing and quenching a workpiece in a furnace having an annealing chamber positioned above a quenching chamber and lateral heat insulation on the annealing chamber extending below the upper surface of the fluidized bed when said bed is not in its fluidized position, said quenching chamber having a fluidizable solid bed therein, said fluidizable bed when in the rest position serving as the bottom heat insulation for said annealing chamber, said process comprising flowing gas into said quenching chamber with a force sufficient to maintain the bed as a fluidized bed while said workpiece is in said bed and stopping the flow of said gas when the workpiece is inside said annealing chamber.

* * * * *